United States Patent [19]

Smrt

[11] Patent Number: 4,792,122

[45] Date of Patent: Dec. 20, 1988

[54] FENCE BRACKET

[76] Inventor: Thomas J. Smrt, 640 Industrial Dr., Cary, Ill. 60013

[21] Appl. No.: 65,884

[22] Filed: Jun. 24, 1987

Related U.S. Application Data

[63] Continuation-in-part of Ser. No. 934,164, Nov. 21, 1986, abandoned, which is a continuation-in-part of Ser. No. 887,385, Jul. 21, 1986, Pat. No. 4,688,769.

[51] Int. Cl.[4] ..... E04H 17/14

[52] U.S. Cl. ..... 256/68; 256/54; 256/DIG. 4; 403/397

[58] Field of Search ..... 403/397, 394, 398; 256/DIG. 4, 68, 57, 54, 65

[56] References Cited

U.S. PATENT DOCUMENTS 305,103 9/1884 Newton ..... 256/DIG. 4
925,229 6/1909 Rider ..... 256/57
3,748,808 7/1973 Sheppard ..... 403/397 X

*Primary Examiner*—Andrew V. Kundrat
*Attorney, Agent, or Firm*—Wood, Dalton, Phillips, Mason & Rowe

[57] ABSTRACT

A fence bracket for mounting adjacent fence rails in fixed relation on a fence post includes first and second fingers extending around a portion of the fence post and each having a hooked portion which is disposed over and engages at least one flange of the post wherein at least one of the fingers is engageable with one of a series of protrusions on a face of the post to limit movement of the bracket thereon. Means are also provided between the first and second fingers for supporting overlapping ends of adjacent rails whereby a fastener may be driven through the overlapping ends to secure the rails in fixed relation on the post. The bracket may be installed from the side of the post and hence does not require the prior removal of other fencing apparatus supported thereby.

14 Claims, 3 Drawing Sheets

FIG. 13
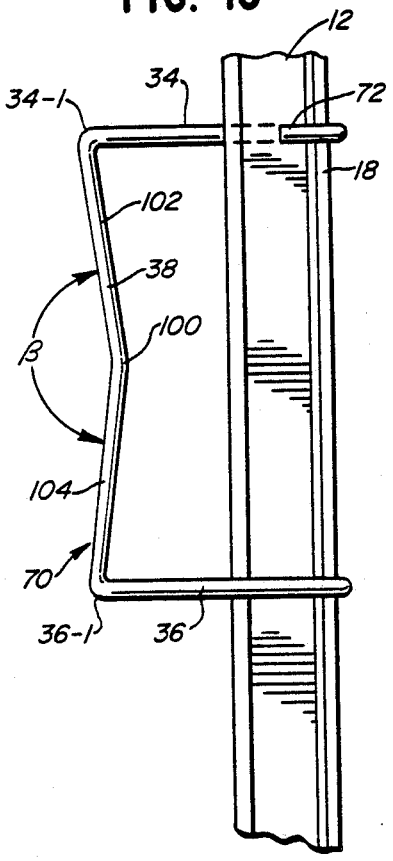
FIG. 14
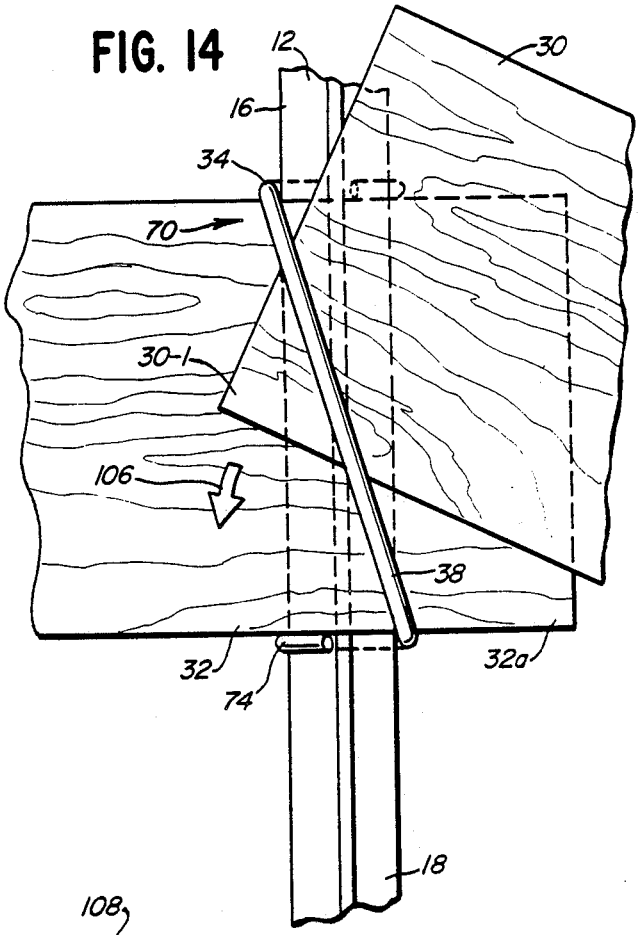
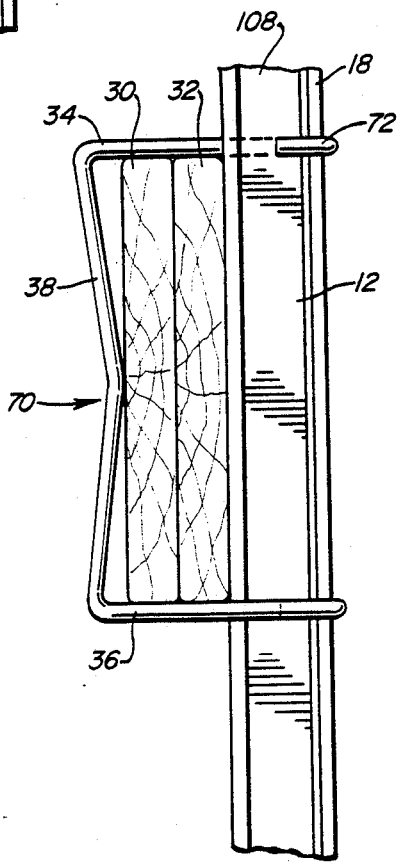
FIG. 15

FENCE BRACKET

CROSS-REFERENCE TO RELATED APPLICATION

This is a continuation-in-part application of Smrt U.S. Ser. No. 934,164, filed Nov. 21, 1986 entitled "Fence Bracket" now abandoned, which is in turn a continuation-in-part application of Smrt Ser. No. 887,385, filed July 21, 1986 entitled "Fence Bracket", now U.S. Pat. No. 4,688,769.

DESCRIPTION

1. Technical Field

The present invention relates generally to fence construction and more particularly to a bracket for securing wooden or other rails on a metal fence post.

2. Background Art

Fences have been designed and constructed wherein horizontal rails are secured to vertical metal fence posts by means of hooks or clasps. For example, Bettis U.S. Pat. No. 57,073 discloses the use of iron hooks which surround a circular metal fence post and which are secured at a desired height on the post by a wedge or key. Overlapping horizontal boards extend through a front portion of the iron hook and are supported thereby.

Gleason U.S. Pat. No. 266,988 discloses a metallic clasp for securing overlapping rails on a fence post. The clasp includes a pair of hooked portions, one of which extends through an aperture in the middle of the post and is hooked around a rear edge of the side of the post, and the other of which is retained within a recess to maintain the bracket at the desired height on the post. The clasp is specifically adapted for use with fence posts having recesses in one face thereof.

Applicant has also designed a prior type of bracket for securing a wooden or other horizontal fence rail to a metal fence post. In applicant's copending patent application entitled "Fence Mounting Bracket", Ser. No. 715,493, filed Mar. 25, 1985, there is disclosed a bracket which includes a frame that is slidable on the post and means associated with and bendable relative thereto into interfering relationship with one or more protrusions on the fence post to maintain the bracket at a fixed height on the post. The bracket includes at least one, and preferably two arms each of which includes a bearing edge for supporting rails.

The first two devices described above suffer from various disadvantages. For example, the hooks disclosed in Bettis can only be installed on a fence post by sliding the hook over the top of the fence post and down the length of the fence post until the desired height is reached. Therefore, barbed wire or other fencing apparatus already on the post must be removed before the hook can be installed.

The metallic clasp of Gleason can be installed while wire is fixed on the post. However, the clasp is only capable of use with one type of fence post, i.e. those having a recess on one face thereof. This type of fence post is not in wide use today and hence the Gleason clasp currently has limited usefulness, at best.

While the fence mounting bracket disclosed in applicant's above-identified copending patent application is highly useful to secure horizontal rails on currently widely available fence posts, this bracket also suffers from the limitation in that it cannot be installed on the post when the post is already supporting fencing apparatus.

SUMMARY OF THE INVENTION

In accordance with the present invention, a fence bracket is provided for mounting horizontal rails on widely used metal fence posts and can be installed even while the post is supporting other fencing apparatus.

More particularly, a first embodiment of the fence bracket of the present invention is particularly adapted for use on T-shaped metal fence posts that include a rearward face having a series of protrusions longitudinally spaced along the face. The bracket includes first and second fingers extending around a portion of the fence post wherein each finger includes a hooked portion which is disposed over and engages a flange of the fence post. At least one of the fingers is engageable with one of the protrusions to limit movement of the bracket on the post. Also included is means connecting the first and second fingers for supporting overlapping ends of adjacent fence rails so that the rails may be mounted in fixed relation on the fence post. In the preferred embodiment, both of the fingers are disposed in planes transverse to the longitudinal axis of the post and the supporting means comprises first and second support members joined to the first and second fingers, respectively, and a connecting member extending between the support members to define an opening forwardly of the fence post for accepting the overlapping ends of the adjacent rails.

In the preferred embodiment, the first and second support members are positioned on opposite sides of the post and the connecting member forms an angle with respect to the longitudinal axis of the post. In an alternative embodiment, the first and second support members are positioned on the same side of the post and the connecting member is substantially parallel to the longitudinal axis of the post.

In a still further embodiment of the invention which is particularly suitable for use with fence posts of U-shape in cross-section having an outturned flange on the end of each leg of the U wherein a series of protrusions are spaced longitudinally along each flange, each finger of the bracket includes an elongate extension portion disposed between the hooked portion and the portion straddling a rear face of the post so that the fingers extend across the rearward face and one of the adjacent side faces of the post. In this case, the hooked portion engages the end of one of the flanges or legs of the U so that the bracket is held firmly on the post.

In each embodiment, one or more fasteners, such as a nail, may be driven through the overlapping ends of the rails so that the rails are securely fastened to the post.

Also, in each embodiment the bracket is easily assembled on the post from the side or front rather than from the top simply by engaging each hooked portion on the appropriate flange of the post so that the fingers rest squarely against the rear face of the post. In this fashion, there is no need to remove any existing fencing apparatus which is already supported by the post.

BRIEF DESCRIPTION OF THE DRAWINGS

FIG. 13 is a side view of a further preferred embodiment of the present invention on a T-shaped metal fence post;

FIG. 14 is an elevational view of the fence bracket of FIG. 13 with fence rails partially assembled therein; and FIG. 15 is a view similar to FIG. 13 with the fence rails fully assembled within the bracket.

DESCRIPTION OF THE PREFERRED EMBODIMENT

Figures 1, 2, 3, 4, 5, 6:
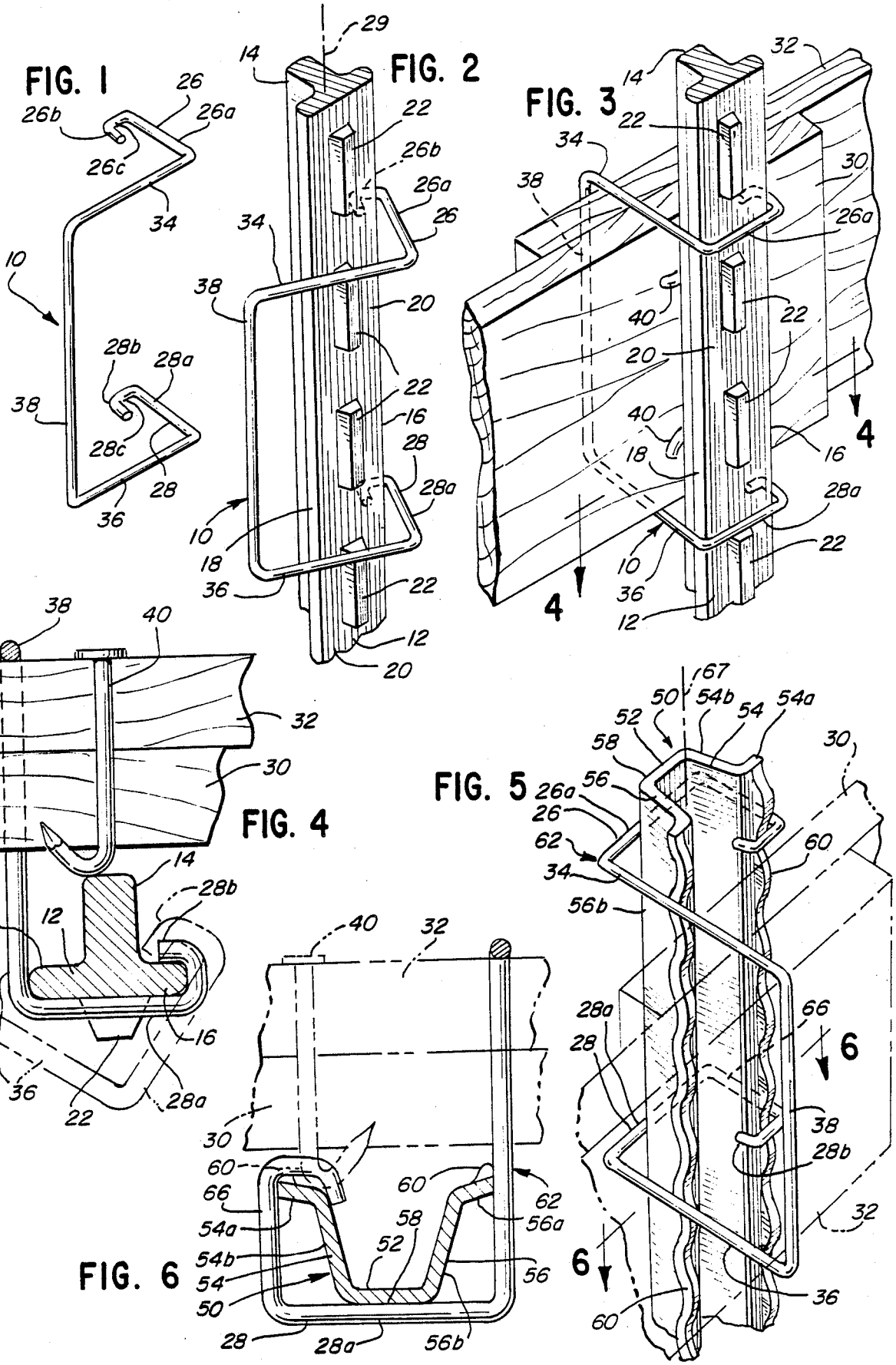
FIG. 1 is a perspective view of a first embodiment of the bracket of the present invention for use with T-shaped metal fence posts.
FIG. 2 is a perspective view of the bracket of FIG. 1 partially assembled on a metal fence post taken from a different angle from that of FIG. 1.
FIG. 3 is a view similar to FIG. 2 showing the bracket as fully assembled on the post.
FIG. 4 is a sectional view taken along lines 4—4 of FIG. 2 with overlapping fence rails shown assembled within the bracket.
FIG. 5 is a perspective view of an alternative embodiment of the invention for use with U-shaped metal posts.
FIG. 6 is a sectional view taken along the lines 6—6 of FIG. 5 with overlapping fence rails shown assembled within the bracket.
Figure 7:
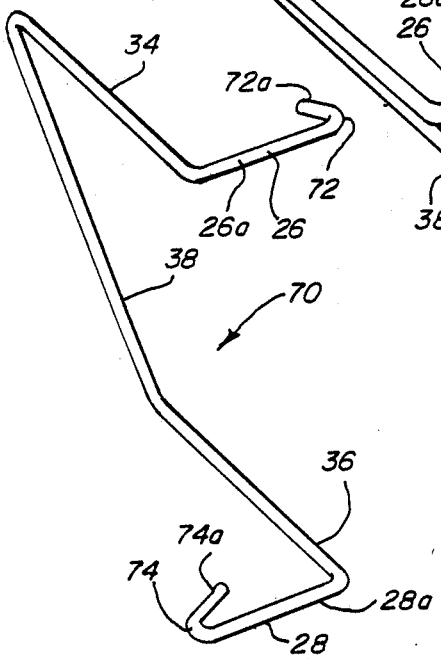
FIG. 7 is a view similar to FIG. 1 illustrating a preferred embodiment of the bracket of the present invention for use with T-shaped metal fence posts.
Figure 8:
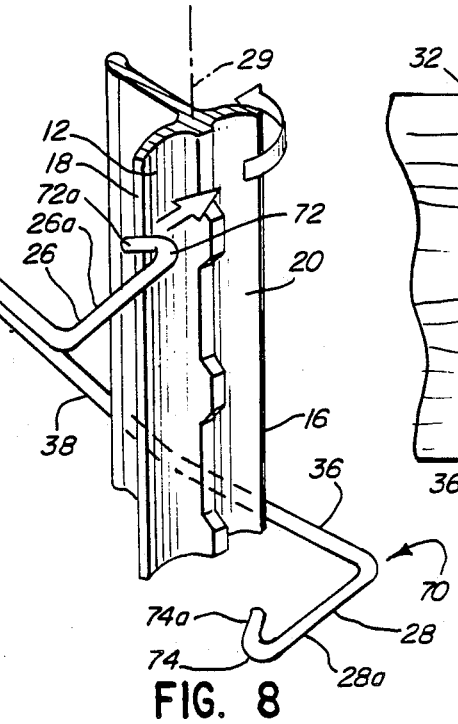
FIGS. 8–11 are perspective views illustrating the sequence of assembly of the bracket shown in FIG. 7 on a T-shaped metal fence post.

Referring now to FIGS. 1–4, there is illustrated in detail a first embodiment of a fence bracket 10 according to the present invention. As seen in FIGS. 3 and 4, the bracket 10 is particularly adapted for use with T-shaped fence posts 12 having a main body or portion 14, first and second longitudinal flanges 16,18 and a rear face 20 having protrusions 22 spaced longitudinally along the face 20.

The bracket 10 includes first and second fingers 26,28 each having main portions **26*a*,28*a*, respectively. Each finger 26,28 also includes hooked portions 26*b*,28*b*, respectively. As seen in FIGS. 3 and 4, when the bracket 10 is in installed position on the post 12, the fingers extend around a portion of the fence post and more particularly straddle or extend across the rear face 20, and are disposed over and engage the flange 16 of the post. Further, one or both of the main portions 26*a*,28*a* is engageable with one or more of the protrusions 22 to limit longitudinal, i.e. upward and downward, movement of the bracket 10 on the post 12. Typically, one of the main portions 26*a*,28*a* is engageable with one protrusion to limit downward movement while the other of the main portions 26*a*,28*a*** is engageable with a different protrusion to limit upward movement, although this need not be the case.

As seen in the figures, the fingers 26,28 are disposed in planes transverse to the longitudinal axis 29 (FIG. 2) of the post 12. The fingers are disposed in substantially horizontal planes when the longitudinal axis 29 of the fence post is substantially vertical, as is the usual case. Means are provided for supporting overlapping ends 30,32 of adjacent fence rails so that the rails are mounted in fixed relation on the fence post 12. In this embodiment of the invention, the supporting means comprises first and second support members 34,36 which are transversely disposed with respect to the longitudinal axis of the post and which are joined to and associated with the main portions **26*a*,28*a* of the fingers 26,28, respectively. Each support member 34,36 is disposed on the same side of the longitudinal axis 29, lies in the same plane as its associated main portion 26*a*, 28*a* and is disposed transversely relative thereto. A connecting member 38 which is substantially parallel to the longitudinal axis 29 of the post extends between and is joined to the support members 34,36. The support members 34,36 and the connecting member 38 together define an opening through which the ends 30,32 may extend. It can be seen that this opening extends forwardly of the fence post 12** and slightly to one side thereof.

As should be evident, when the fence post is substantially upright so that its longitudinal axis 29 is coincident with the vertical, the support members will be horizontally disposed and the connecting member will be parallel to a vertical line. This will not be the case, however, when the fence post longitudinal axis 29 is not coincident with the vertical.

One or more fasteners, such as a nail 40, may be driven through the overlapping ends 30,32 of the rails to fasten same in fixed relation on the post 12. Depending upon the length of nail 40 used, it may occur that the nail strikes the main body 14 of the post 12 and is bent either to one side or the other of the main body (dotted line, FIG. 4) or back into one or both of the ends 30,32 of the rails.

Referring now specifically to FIGS. 2 and 3, the bracket 10 is installed from the side of the post by first hooking the hooked portions **26*b*,28*b* of the fingers 26,28 over either of the flanges 16,18 of the post 12. The bracket 10 is then rotated so that the finger main portions 26*a*, 28*a* of the fingers 26,28 are substantially in contact with or abut the rear face 20 of the post 12. An opening is thereby defined by the support members 34,36, the connecting member 38 and the post 12 within which the adjacent overlapping ends of the rails may be captured. The length of the support members 34,36 is selected keeping in mind the thickness of the rails so that the rails prevent substantial rotational movement of the bracket 10** once assembled on the post.

The length of each hooked portion **26*b*,28*b*** is selected so that the bracket may be easily installed on the post and so that the hooked portions prevent substantial movement on the post and inadvertent detachment of the bracket from the post prior to assembly of the rails in the bracket.

In this embodiment, the bracket 10 is formed of a single piece of 3/16 inch diameter stainless steel rod which is bent or otherwise formed to the desired shape. Further, each of the support members 34,36 is approximately 2 15/16 inches in length, each of the main portions **26*a*,28*a* is approximately 1 11/32 inches in length, the connecting member 38 is approximately $5\frac{5}{8}$ inch in length and the portions disposed at 90° with respect to one another of the hooked portions 26*b*,28*b* are each approximately $\frac{1}{4}$ inch in length. By changing the length of the connecting member 38, different size rails may be supported on the post 12**.

As previously noted, the bracket shown in FIGS. 1–4 is particularly adapted for use with T-shaped fence posts. Referring now to FIGS. 5 and 6 there is illustrated a further embodiment of the invention which is adapted for use with U-shaped metal posts. It should be noted that structures or elements which are common to the figures are designated with like reference numerals.

A U-shaped post 50 includes a main portion 52 and first and second longitudinal legs 54,56 spaced on either side of the main portion 52. Disposed on the end of each leg 54,56 is an outturned flange 54a,56a, respectively. A series of protrusions 60 are longitudinally spaced along each flange 54a,56a. A bracket 62 includes the fingers 26, 28 having main portions 26a,28a as disclosed in FIGS. 1–4. The fingers 26,28 also include the hooked portions 26b,28b; however, the hooked portions 26b,28b are joined to the main portions 26a,28a by extensions 64,66, respectively, which, when the bracket 62 is installed on the post 50, are adjacent one of a pair of side faces 54b,56b of the legs 54,56.

The bracket 62 includes the support members 34,36 and the connecting member 38 described in connection with FIGS. 1–4. As before, the connecting member is substantially parallel to the longitudinal axis 67 (FIG. 5) of the post 50.

The bracket 62 is installed on the fence post 50 in a similar fashion as described in connection with the previous embodiment. That is, the bracket 62 is installed from the side of the post 50 by placing the hooked portions 26a,26b over one of the flanges 54a,56a and the end of one of the legs 54,56 (shown in the figures as being placed over the flange 54a and the end of the leg 54) and by rotating the bracket 62 relative to the post 50 until the main portions 26a,26b substantially abut the rear face 58. In this embodiment, substantial longitudinal movement of the brackets 62 relative to the post is prevented by the engagement of one or both of the hooked portions 26b,26c with one or more protrusions 60. The bracket 62, when installed, therefore includes fingers 26,28 which extend across the rear face 58 and at least one and preferably both side faces 54b, 56b.

Once the bracket is installed on the post, the ends 30,32 of the adjacent rails are passed through the opening defined by the support members 34,36 and the connecting member 38, and one or more nails or fasteners is driven through the overlapping ends 30,32 to hold the rails in place relative to the post 50.

It should be noted that the placement of the fastener or nail 40 as shown in the figures is not critical, it being understood that the nail may pass through the ends 30, 32 at another place, if desired.

Referring now to FIGS. 7–12, there is illustrated a preferred embodiment of the invention for use with T-shaped fence posts of slightly different shape than that shown in FIGS. 1–4. Basically, the post differs from that shown in FIGS. 1–4 in that the flanges are somewhat thinner and are curved. Again, elements common between this embodiment and the first embodiment disclosed in FIGS. 1–4 are assigned like reference numerals.

A bracket 70 includes the fingers 26,28, the support members 34,36 and the connecting member 38 described in connection with the first embodiment. However, as seen specifically in FIGS. 7 and 12, the support members 34,36 do not lie in the same plane when assembled on the post 12 and in fact lie on opposite sides of the longitudinal axis 29 of the post. Further, the fingers 26,28 extend in opposite directions across the rear face 20. The fingers 26,28 include hooked portions 72,74, respectively, which extend around the flanges 18,16, respectively. Advantageously, the hooked portions 72,74 are not identical to the hooked portions 26b, 28b inasmuch as the hooked portions 72,74 do not include the short members 26c,28c (FIG. 1) disposed between the main portions 26a,28a and the ends of the hooked portions 26b, 28b shown in FIG. 1. Instead, the hooked portions 72,74 include ends 72a,74a, respectively, which form an angle with respect to the main portions 26a,28a of the fingers 26,28. The shape of the hooked portions 72,74 facilitates mounting of the bracket 70 on the slightly curved flanges 16,18 of the post 12.

The only other practical difference between the post shown in FIGS. 1–4 and the post illustrated in FIGS. 7–12 is that the protrusions are somewhat smaller in the latter. This difference, however, is not significant in the design of the bracket since one or both of the fingers will engage at least one protrusion regardless of the size or spacing of the protrusions.

Referring now to FIGS. 8–11 which illustrate the method of installing the bracket 70 on the post 12, the bracket 70 is first turned with respect to the post 12 so that one of the hooked portions 72,74 may be hooked over one of the flanges 18,16. In the example shown in the figures, the hooked portion 72 is hooked over the flange 18 so that the end 72a is disposed on the opposite side of the flange 18 from the main portion 26a of the finger 26. In addition, the finger 28 is positioned so that it extends across the rear face 20; however, at this time the hooked portion 74 has not been placed over the flange 16.

The next step in the installation procedure is to manually push the bottom of the bracket 70 back in the direction of the arrow 80 so that the support member 36 and the finger 28 are rotated in the direction of the arrow 82. Sufficient applied force will result in the end 74a becoming hooked over the flange 16. At this time, the main portion 28a of the finger 28 is spaced from the rear wall 20.

Figure 11:
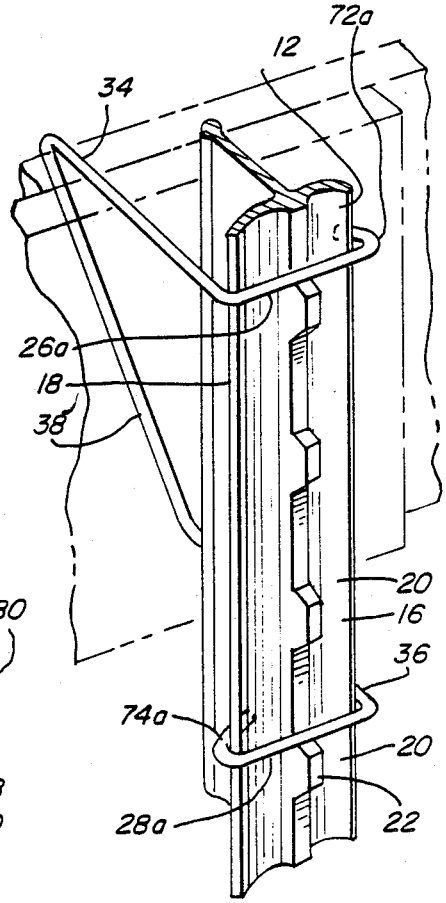

Manual force is then applied to the bottom of the connecting member 38 and/or to the forward portion of the support member 36 so that the bottom of the bracket 70 as a whole is rotated to bring the main portion 28a of the finger 28 into substantial abutment with the rear wall 20, as seen in FIG. 11. As was noted with respect to the preceding embodiments, one or both of the main portions 26a,28a is engageable with one of the protrusions 22 to limit longitudinal movement of the bracket 70 on the post 12.

Figure 12:
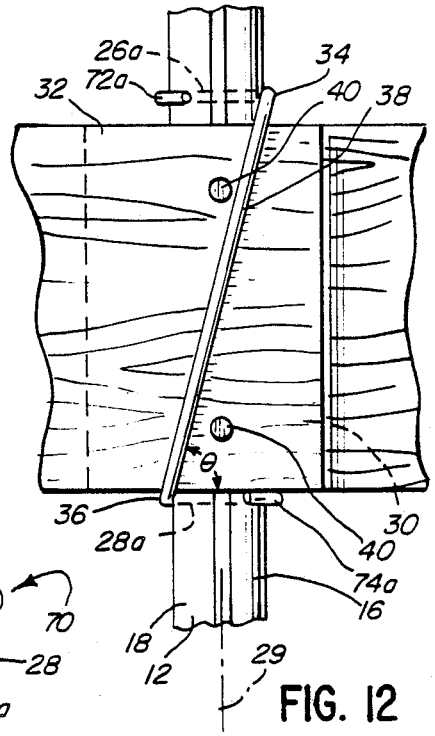
FIG. 12 is an elevational view taken from the front of the post with overlapping fence rails shown assembled within the bracket.
Figure 9:
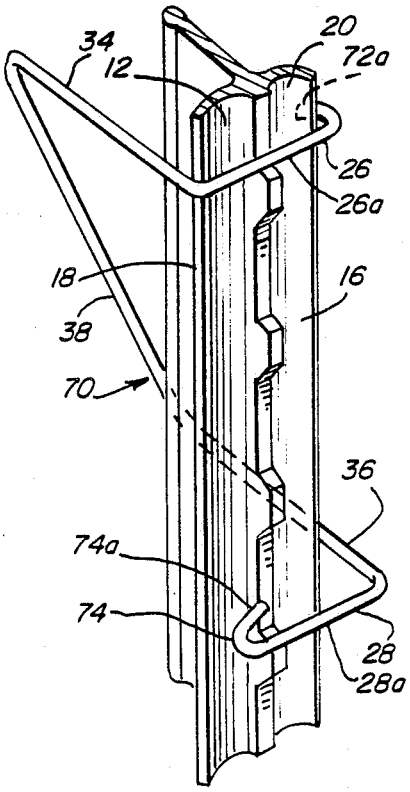
Figure 10:
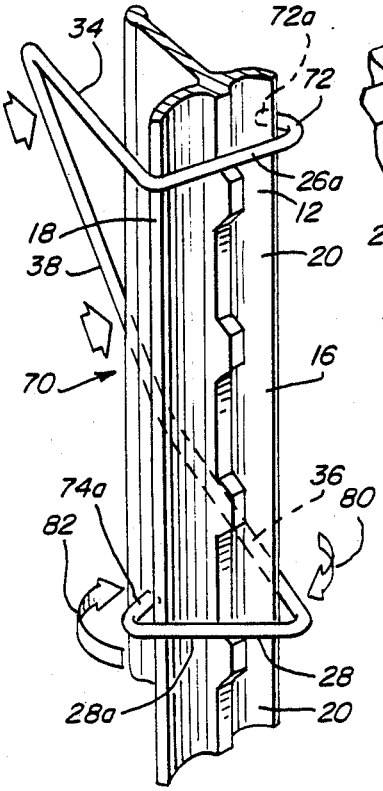

As seen in FIG. 12, the overlapping ends 30,32 of the rails are passed through the opening afforded by the support members 34,36 and the connecting member 38 and one or more fasteners, such as nails 40, may be driven through the overlapping ends to secure the rails in fixed relation on the post 12.

In the preferred embodiment, each of the support members 34,36 is approximately 3.22 inches in length, each of the main portions 26a,26b is approximately 1.45 inches in length, the connecting member 38 is approximately 5.625 inches in length and the members 72a,74a are approximately 0.44 inch in length. The angle between the member 72a and the main portion 26a and the angle between the member 74a and the main portion 28a are both approximately 25°. The bracket 70 is formed of a single piece of 3/16th inch diameter stainless steel rod, similar to the previous embodiments. Furthermore, the angle $\theta$ shown in FIG. 12 between the connecting member 38 and the main portions 26a,28a is approximately equal to 75°. It should be noted that the angle $\theta$ and the length of the connecting member 38 will be different when different sized rails are mounted on the post.

It can be seen in FIG. 12 that the connecting member 38 forms an angle of approximately 15° with respect to the longitudinal axis 29 of the post 12. This angle will also vary in dependence upon the width of the rails which are mounted on the post.

Illustrated in FIGS. 13–15 is a further embodiment of the invention wherein the connecting member 38 is bent inwardly so that some or all of the connecting member 38 is displaced inwardly toward the post 12 relative to outer ends 34-1 and 36-1 of the support members 34–36. In the example shown in FIGS. 13–15, the connecting member 38 is bent inwardly to form an inwardly-displaced flexible portion 100 between first and second substantially linear portions 102, 104 which are disposed at angle $\beta$ with respect to one another. The angle $\beta$ is typically greater than 90° but less than 180°. Of course, this angle depends upon the length of the support members 34, 36 relative to the width of the rails 30, 32 to be maintained therein, as noted in greater detail below.

As should be evident, the connecting member 38 need not be bent inwardly to form first and second linear sections or portions 102, 104, but may be curved to form a concave section or may be otherwise formed to produce a portion displaced inwardly relative to the ends 34-1, 36-1 of the support members 34, 36.

The fence bracket 70 illustrated in FIGS. 13–15 otherwise differs from that shown in FIGS. 7–12 only in the fact that the bracket shown in FIGS. 13–15 is a mirror image of the bracket shown in FIGS. 7–12. Thus, the hooked portion 72 is disposed over the flange 18 and the hooked portion 74 extends around the flange 60, rather than vice versa. This difference in the sense of the bracket is immaterial in terms of the ability of the bracket to mount the fence rails on the post 12.

The method in which the rails 30, 32 are placed within the bracket 70 will now be described with particular reference to FIGS. 14 and 15. The rail 32 is first placed into the bracket 70 forward of the post 12 such that a short end portion 32*a* of the rail 32 extends laterally beyond the post 12. A lower corner 30-1 of the rail 30 is then inserted in the space between the rail 32 and the connecting member 38 above the inwardly displaced portion 100. The rail 30 is thereafter displaced downwardly in the direction of the arrow 106 until it contacts the lower support member 36. The rail 30 may then be displaced laterally to left as seen in FIG. 14 so that the rail extends a short distance to the left of the post 12. Once the rails are inserted within the bracket 70, nails or other fasteners may be driven into the rails 30, 32 to maintain their relative placement on the post 12, if desired.

Advantageously, the length of the support members 34, 36 and the angle $\beta$ are selected such that the inwardly displaced portion 100 is spaced a distance from the edge of a main portion 108 of the post 12 which is slightly less than the combined thicknesses of the two rails 30, 32. Thus, the inwardly displaced portion 100 is deflected somewhat by the rails 30, 32 and bears against the rails 30, 32 to maintain the rails tightly against the edge of the main portion 108. The rails 30, 32 are therefore held tightly against the post 12.

As should be evident from the foregoing, the degree of force exerted on the rails 30, 32 by the connecting portion 38 is a function of several factors, including the stiffness of the material used to make the bracket 70, the distance of the inwardly displaced portion 100 from the edge of the main portion 108 relative to the combined thicknesses of the rails 30, 32, the geometry of the connecting member 38 including the magnitude of the angle $\beta$, etc.

It should be noted that if the force exerted by the connecting member 38 on the rails 30, 32 is sufficient, fasteners or other devices to maintain the relative placement of the rails 30, 32 may not be needed.

The use of the flexible inwardly-displaced portion 100 results in the ability to use the same bracket 70 on fence posts of different depths or thicknesses.

It should further be noted that the bracket of the present invention may be adaptable to other types of metal fence posts having different cross-sectional shapes simply by varying the lengths of the main portions 26*a*,28*a*, the extensions 64,66 in the second embodiment, the support members 34,36 or the hooked portions 26*a*,28*a*,72,74.

The bracket of the present invention provides a simple and effective means of securing horizontal wooden or other rails to a widely used metal fence posts of various cross-sectional shapes without the need of first removing other fencing apparatus supported by the post. Thus, the bracket may be used to secure fence rails to a fence post which already supports other rails or other fencing apparatus. Further, the bracket does not have sharp edges, and hence humans and animals coming into contact with the bracket will not be injured thereby.

I claim:

1. A fence bracket for mounting adjacent fence rails in fixed relation on a generally upright fence post of the type having protrusions longitudinally spaced along the post, where the post includes a longitudinal axis and first and second spaced flanges disposed on opposite sides of the longitudinal axis, comprising:

first and second fingers disposed in planes transverse to the longitudinal axis of the post and extending around a portion of the fence post, each having a hooked portion and wherein the hooked portion of the first finger is disposed over and engages one of the flanges of the fence post and the hooked, portion of the second finger is disposed over and engages the other of the flanges and wherein at least one of the fingers is engageable with one of the protrusions to limit movement of the bracket longitudinally with respect to the post; and means disposed between the first and second fingers for supporting overlapping ends of the adjacent fence rails including first and second support members extending transversely of the longitudinal axis and joined to the first and second fingers, respectively, and a connecting member disposed at an angle with respect to the longitudinal axis of the post extending between and joined to the support members.

2. The fence bracket of claim 1, wherein the post includes first and second flanges and the support members are disposed on opposite sides of the longitudinal axis of the post and wherein the hooked portions of the first and second fingers engage the first and second flanges of the post, respectively.

3. The fence bracket of claim 1, wherein each support member includes an outer end opposite the finger and wherein the connecting member includes an inwardly displaced portion which is disposed nearer the post than the outer ends of the support member wherein the inwardly displaced portion engages one of the overlapping rails to maintain the rails against the post.

4. A fence bracket for securing fence rails to a generally upright fence post of the type having protrusions longitudinally spaced along the post and spaced flanges disposed on opposite sides of a longitudinal axis of the post, comprising:

first and second spaced fingers each having a hooked portion on an end thereof; and supporting means disposed between the first and second fingers;

wherein the hooked portions of the first and second fingers are engaged with different flanges of the fence post and at least one finger is engaged with one of the protrusions of the post to limit longitudinal movement of the bracket on the post and so that overlapping ends of adjacent fence rails may be supported by the supporting means.

5. The fence bracket of claim 4, wherein each finger includes a main portion joined to the hooked portion and wherein the supporting means comprises first and second support members joined to the main portions of the first and second fingers, respectively, and a connecting member joined between the support members, the support members, connecting member and the post together defining an opening with the bracket mounted on the post for accepting overlapping ends of adjacent fence rails whereby the rails are captured within the opening, whereby at least one of the main portions is engageable with one of the protrusions to limit longitudinal movement of the bracket on the post, the support members limit movement of the rails longitudinally along the post and the support members and connecting member together prevent substantial rotational movement of the bracket once the rails are assembled within the opening.

6. The fence bracket of claim 5, wherein the fence post includes a longitudinal axis and wherein the connecting member is disposed at an angle with respect to the longitudinal axis of the post with the bracket assembled thereon.

7. The fence bracket of claim 4, wherein each support means includes an outer end opposite the finger and wherein the connecting member includes an inwardly-displaced portion which is disposed nearer the post than the outer ends of the support means wherein the inwardly-displaced portion engages one of the overlapping rails to maintain the rails against the post.

8. A fence bracket for securing fence rails to a generally upright, metal fence post wherein the post includes a main portion having a face, a series of protrusions spaced longitudinally along the post and first and second longitudinal flanges disposed on opposite sides of the main portion such that the post is T-shaped in cross-section, comprising:

first and second parallel fingers each having a main portion and a hooked portion;

first and second parallel support members coupled to and associated with the first and second fingers, respectively, each support member extending transversely relative to its associated finger; and a connecting member disposed between and secured to the first and second support members and the support and connecting members with the post together defining an opening for receiving at least one fence rail therein, with the bracket installed on the post from the side thereof by first placing one of the hooked portions of the fingers over one of the longitudinal flanges, placing the other hooked portion over the other longitudinal flange and then rotating at least a portion of the bracket so that the main portions of the fingers substantially abut the face of the main portion of the post and at least one of the protrusions limit substantial longitudinal movement of the bracket on the post and the opening extends outwardly from the post.

9. The fence bracket of claim 8, wherein the fence post includes a longitudinal axis and wherein the connecting member is disposed at an angle with respect to the longitudinal axis of the post.

10. The fence bracket of claim 8, wherein each support member includes an outer end opposite the finger and wherein the connecting member includes an inwardly-displaced portion which is disposed nearer the post than the outer ends of the support member wherein the inwardly-displaced portion engages one of the overlapping rails to maintain the rails against the post.

11. A method of assembling a fence using fence rails and fence posts of the type having a pair of flanges on first and second sides thereof and at least one protrusion on a rear face thereof, the method comprising:

providing a fence bracket having first and second hooked fingers, first and second support members joined to the first and second fingers, respectively, and a connecting member joining the first and second support members;

assembling the fence bracket on the fence post such that the first and second hooked fingers extend around and engage the first and second flanges, respectively, and at least one of the fingers engages the protrusion to limit downward shifting of the fence bracket on the fence post whereby an opening is defined forwardly of the fence post by the connecting member and the support members;

passing an end of one fence rail through the opening from a first side thereof; and passing an end of a second fence rail through the opening from a second side thereof opposite the first whereby the ends of the first and second fence rails overlap within the opening.

12. The method claim 11, including the further step of passing a fastener through the overlapping ends of the first and second fence rails.

13. The method of claim 11, wherein the step of assembling includes the step of placing one of the hooked fingers over one of the flanges, rotating a portion of the fence bracket in a first direction to permit the other of the hooked fingers to be placed over the other of the flanges and rotating the portion of the fence bracket in a second direction opposite the first so that a portion of at least one of the fingers abuts the rear face of the post.

14. The method of claim 11, wherein the means defining the opening includes a connecting member disposed between first and second support members, the connecting member including an inwardly displaced portion which is disposed nearer the post than outer ends of the support members when the fence bracket is assembled on the post and wherein the step of passing the end of the second fence rail through the opening includes the step of forcing the end of the second fence rail between the end of the first fence rail and the inwardly displaced portion whereby the inwardly displaced portion exerts a force on the overlapping ends to push such ends against the fence post.

* * * * *